US008047773B2

(12) United States Patent
Bruce et al.

(10) Patent No.: US 8,047,773 B2
(45) **Date of Patent: *Nov. 1, 2011**

(54) GAS TURBINE SHROUD SUPPORT APPARATUS

(75) Inventors: Kevin Leon Bruce, Greer, SC (US); Ronald Ralph Cairo, Greer, SC (US); Ronald Phillip Nimmer, Schenectady, NY (US); Curtis Alan Johnson, Niskayuna, NY (US); Gregory Scot Corman, Ballston Lake, NY (US); Herbert Chidsey Roberts, III, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 1103 days.

This patent is subject to a terminal disclaimer.

(21) Appl. No.: 11/844,046

(22) Filed: Aug. 23, 2007

(65) Prior Publication Data

US 2009/0053050 A1 Feb. 26, 2009

(51) Int. Cl.
*F01D 11/12* (2006.01)

(52) U.S. Cl. ..... 415/173.3; 415/173.4

(58) Field of Classification Search ..... 415/173.4, 415/173.3, 174.1, 174.2

See application file for complete search history.

(56) References Cited

U.S. PATENT DOCUMENTS

| | | | | |
|---|---|---|---|---|
| 7,238,002 | B2 | 7/2007 | Cairo et al. | |
| 2007/0098546 | A1 * | 5/2007 | Cairo et al. | 415/170.1 |
| 2007/0280820 | A1 * | 12/2007 | Roberts et al. | 415/139 |
| 2008/0081109 | A1 * | 4/2008 | Johnson et al. | 427/180 |

OTHER PUBLICATIONS

U.S. Appl. No. 11/537,278, "Method for Applying and Dimensioning an Abradable Coating", filed Sep. 29, 2006 by Curtis Alan Johnson et al.

U.S. Appl. No. 11/537,238, "Porous Abradable Coating and Method for Applying the Same", filed Sep. 29, 2006 by Curtis Alan Johnson et al.

U.S. Appl. No. 11/443,723, "Methods and Apparatus for Assembling Turbine Engines", filed May 31, 2006 by Herbert Chidsey Roberts, Ill, et al.

* cited by examiner

*Primary Examiner* — Richard Edgar

(74) *Attorney, Agent, or Firm* — Cantor Colburn LLP

(57) ABSTRACT

A support apparatus for a gas turbine shroud is disclosed. The apparatus includes an outer shroud block having a coupling connectable to a casing of the gas turbine and a shroud component having a forward flange and an aft flange. The shroud component is attached to the outer shroud block via the forward flange and the aft flange. The apparatus further includes a damper disposed between the outer shroud block and the shroud component and a biasing element disposed within the outer shroud block. A translational degree of freedom between the damper and the outer shroud block defines a direction of motion of the damper. The biasing element is in operable connection between the outer shroud block and the shroud component via the damper, a bias force of the biasing element directed along the direction of motion of the damper.

21 Claims, 7 Drawing Sheets

GAS TURBINE SHROUD SUPPORT APPARATUS

BACKGROUND OF THE INVENTION

This invention relates to gas turbines and specifically, to gas turbine shroud supports.

In a gas turbine engine, such as may be used for electrical power generation for example, in order to achieve enhanced engine efficiency it is desired that buckets rotate within a turbine case or "shroud" with reduced clearance to provide enhanced efficiency relative to an amount of energy available from an expanding working fluid. Typically, increased operation efficiencies can be achieved by maintaining a reduced threshold clearance between the shroud and tips of the buckets, which prevents unwanted "leakage" of hot gas over tips of the buckets. Increased clearances lead to leakage problems and cause reduction in overall efficiency of the turbine.

Ceramic matrix composites offer advantages as a material of choice for shrouds in a turbine for interfacing with the hot gas path. The ceramic matrix composites can withstand high operating temperatures and are suitable for use in the hot gas path of gas turbines. Recently, melt-infiltrated (MI) silicon-carbon/silicon-carbon (SiC/SiC) ceramic matrix composites (CMC) have been formed into high temperature, static components, such as gas turbine shrouds for example. Because of their heat capability, ceramic matrix composite turbine components, such as components made from MI-SiC/SiC components for example, generally allow for a reduction in cooling flow, as compared to metallic components.

It will be appreciated that the shrouds are subject to vibration due to pressure pulses of the hot gases as each bucket passes the shroud. Moreover, because of this proximity to high-speed rotating buckets, the vibration may be at or near resonant frequencies and thus require damping to enhance life expectancy during long-term commercial operation of the turbine. Ceramic composites require unique attachment and have multiple failure mechanisms such as wear, oxidation, stress concentration and damage to the ceramic composite when configuring the composite for attachment to the metallic components. Accordingly, there is a need for responding to dynamics-related issues relating to the attachment of ceramic composite shrouds to metallic components of the turbine to minimize adverse modal response.

BRIEF DESCRIPTION OF THE INVENTION

An embodiment of the invention includes a support apparatus for a gas turbine shroud. The apparatus includes an outer shroud block having a coupling connectable to a casing of the gas turbine and a shroud component having a forward flange and an aft flange. The shroud component is attached to the outer shroud block via the forward flange and the aft flange. The apparatus further includes a damper disposed between the outer shroud block and the shroud component and a biasing element disposed within the outer shroud block. A translational degree of freedom between the damper and the outer shroud block defines a direction of motion of the damper. The biasing element is in operable connection between the outer shroud block and the shroud component via the damper, a bias force of the biasing element directed along the direction of motion of the damper.

Another embodiment of the invention includes a support apparatus for a shroud of a gas turbine, the gas turbine having a rotating shaft that defines a radial direction perpendicular thereto. The apparatus includes an outer shroud block including a coupling connectable to a casing of the gas turbine and a melt-infiltrated ceramic matrix composite inner shroud component having a forward flange and an aft flange. The melt-infiltrated ceramic matrix composite inner shroud component shroud component is attached to the outer shroud block via the forward flange and the aft flange. The apparatus further includes a damper disposed between the outer shroud block and the melt-infiltrated ceramic matrix composite inner shroud component. A translational degree of freedom between the damper and the outer shroud block defines a direction of motion of the damper which forms an angle greater than zero degrees relative to the radial direction of the gas turbine. The apparatus further includes a biasing element disposed within the outer shroud block and in operable connection between the outer shroud block and the melt-infiltrated ceramic matrix composite inner shroud component via the damper. A bias force of the biasing element is directed along the direction of motion.

These and other advantages and features will be more readily understood from the following detailed description of preferred embodiments of the invention that is provided in connection with the accompanying drawings.

BRIEF DESCRIPTION OF THE DRAWINGS

Referring to the exemplary drawings wherein like elements are numbered alike in the accompanying Figures.

DETAILED DESCRIPTION OF THE INVENTION

An embodiment of the invention provides a shroud assembly having a canted damper block to increase sealing and vibration tolerance. Additional features described herein increase sealing within the assembly and reduce operating clearances with rotating buckets to reduce leakage beyond the rotating buckets, thereby enhancing engine operational efficiency.

Figure 1:
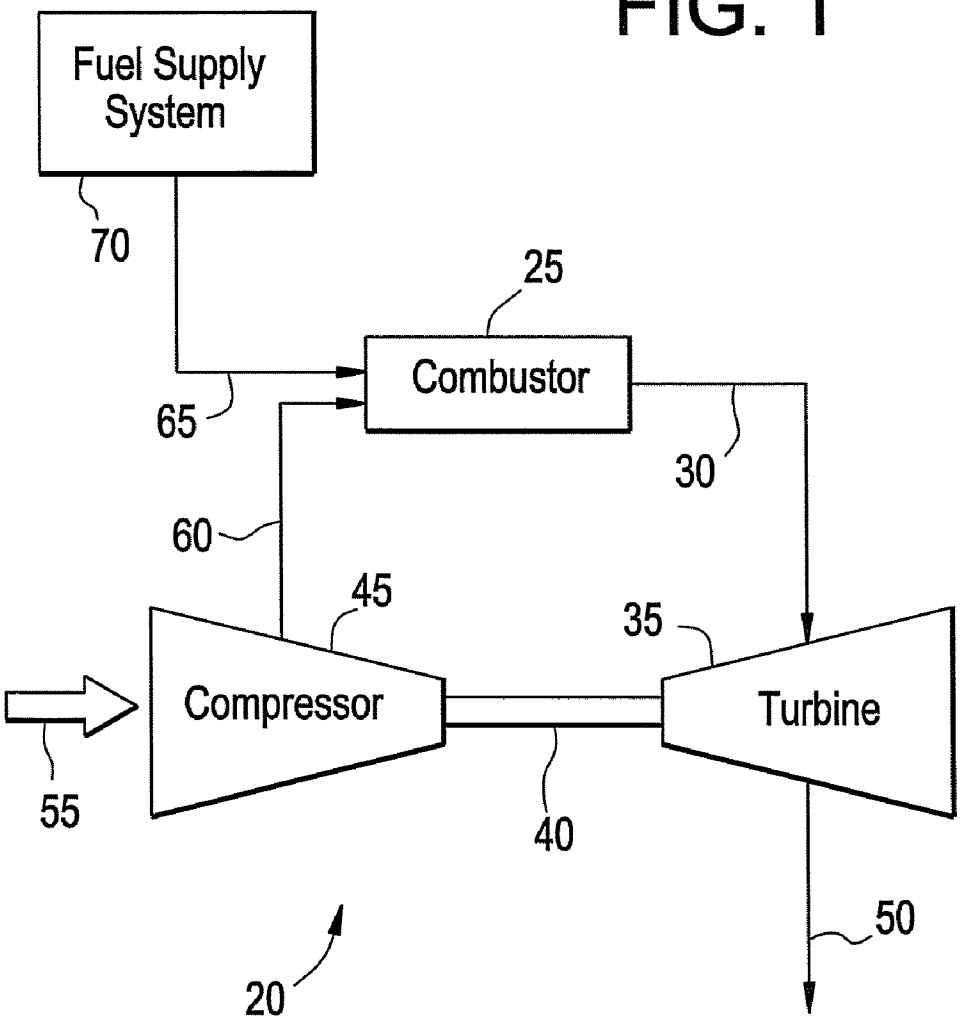
FIG. 1 depicts a schematic drawing of an embodiment of a turbine engine in accordance with an embodiment of the invention.

FIG. 1 depicts a schematic drawing of an embodiment of a turbine engine 20, such as a gas turbine engine 20. The gas turbine engine 20 includes a combustor 25. Combustor 25 burns a fuel-oxidant mixture to produce a flow of gas 30 that is hot and energetic. The flow of gas 30 from the combustor 25 then travels to a turbine 35. The turbine 35 includes an assembly of turbine buckets (not shown). The flow of gas 30 imparts energy on the assembly of buckets causing the assembly of buckets to rotate. The assembly of buckets is coupled to a shaft 40. The shaft 40 rotates in response to a rotation of the assembly of buckets. The shaft 40 is then used to power a compressor 45. The shaft 40 can optionally provide a power output 50 to a different output device (not shown), such as, for example, an electrical generator. The compressor 45 takes in and compresses an oxidant stream 55. Following compression of the oxidant stream 55, a compressed oxidant stream 60 is fed into the combustor 25. The compressed oxidant stream 60 from the compressor 45 is mixed with a fuel flow 65 from a fuel supply system 70 to form the fuel-oxidant mixture inside the combustor 25. The fuel-oxidant mixture then undergoes the burning process in the combustor 25.

Figure 2:
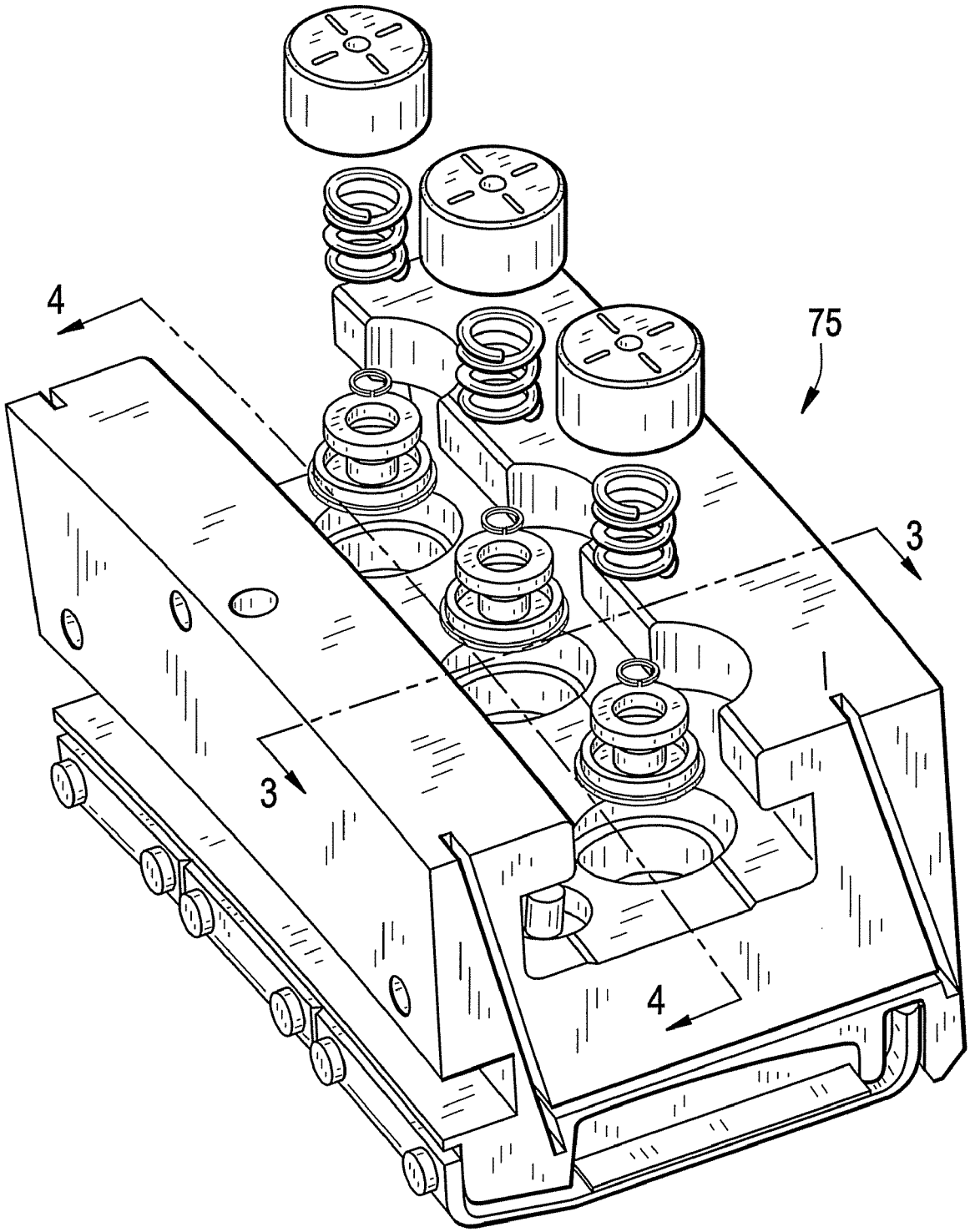
FIG. 2 depicts an isometric exploded assembly view of a shroud assembly in accordance with an embodiment of the invention.

FIG. 2 depicts an isometric exploded assembly view of a shroud assembly 75 that will be explained further in cross sectional views thereof with reference to FIGS. 3 and 4.

Figure 3:
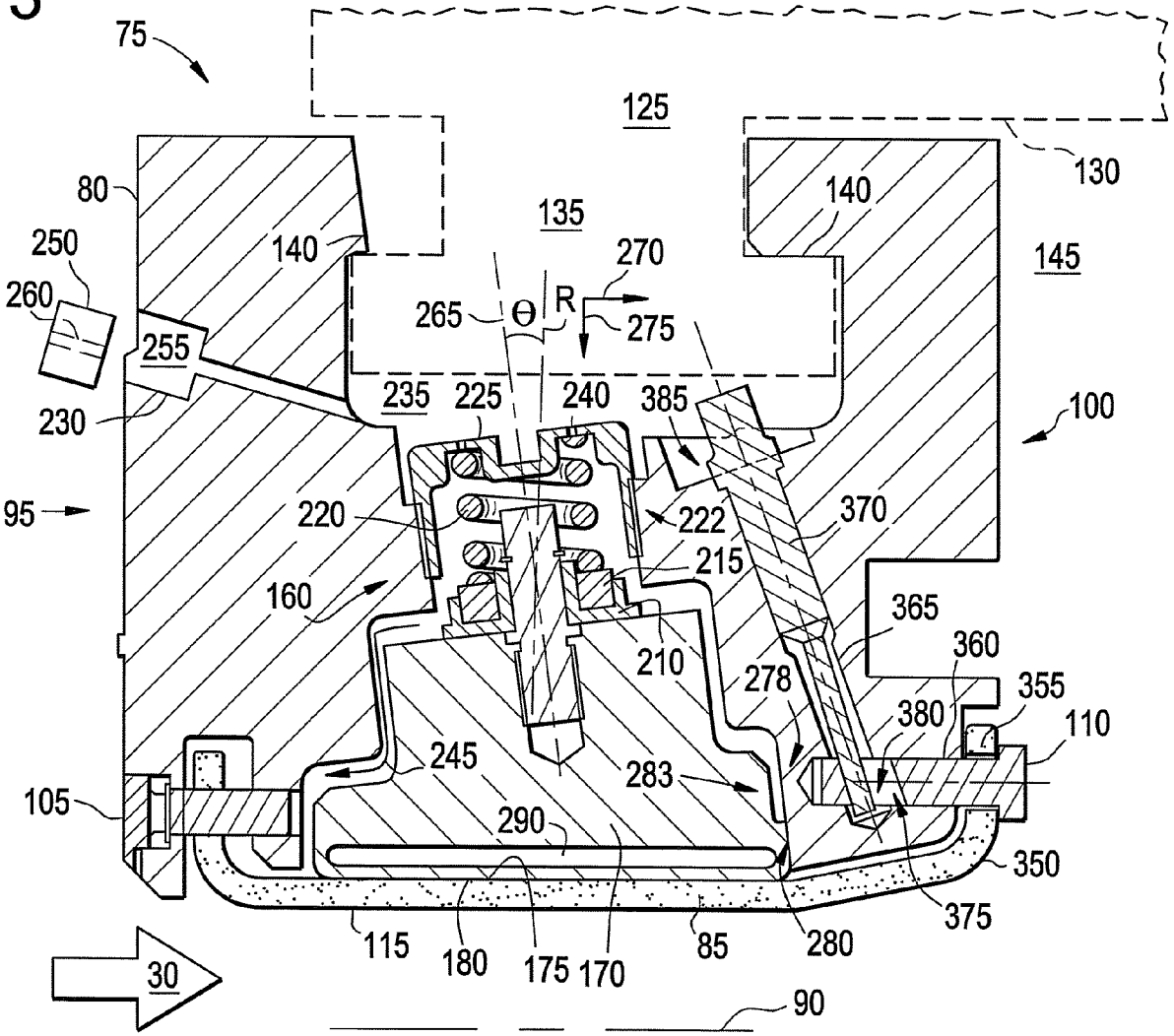
FIG. 3 depicts a cross-sectional view through the shroud assembly of FIG. 2 as viewed in a circumferential direction about an axis of the turbine in accordance with an embodiment of the invention.
Figure 4:
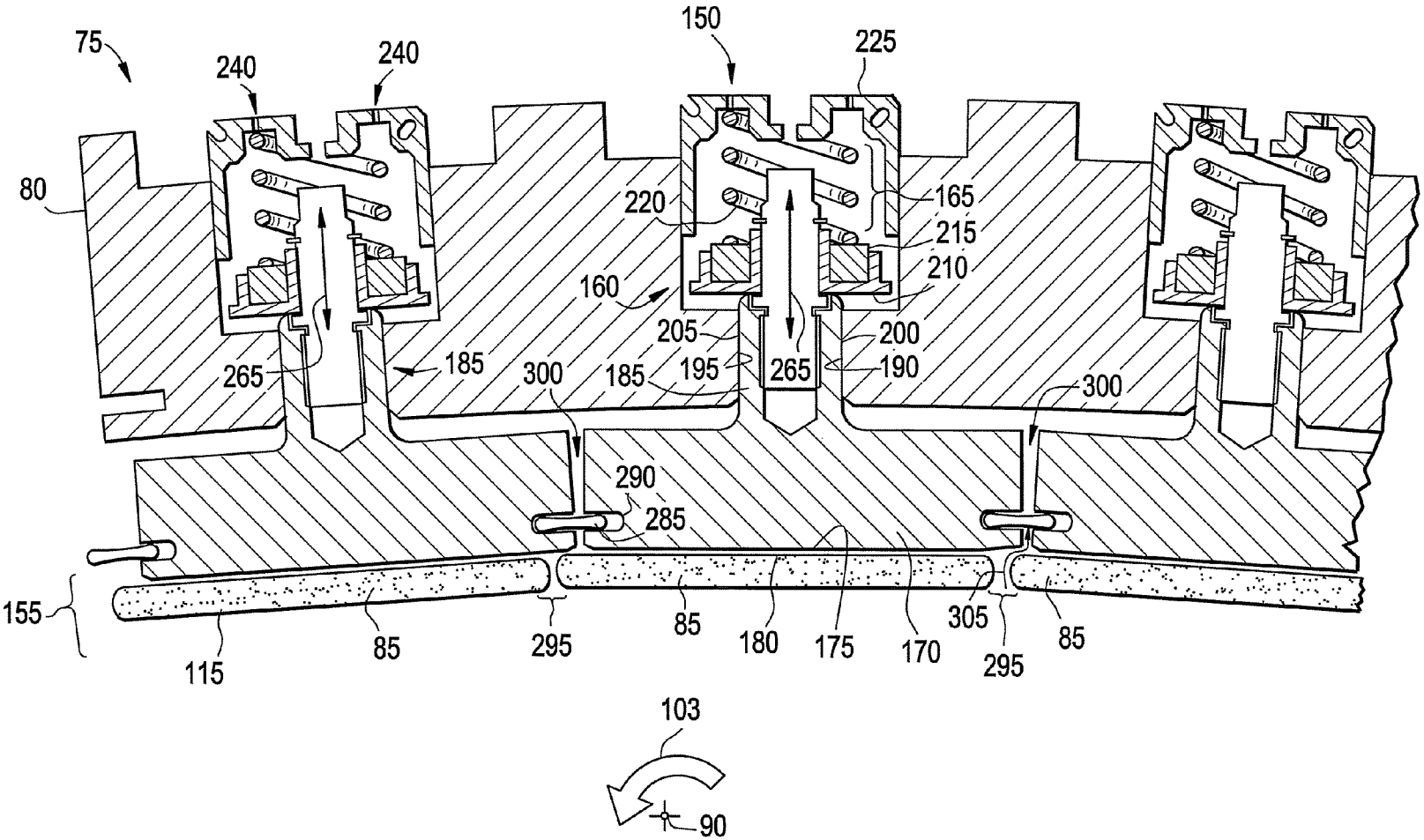
FIG. 4 depicts a cross-sectional view of through the shroud assembly of FIG. 2 as viewed in an axial forward direction in accordance with an embodiment of the invention.

FIGS. 3 and 4 depict the shroud assembly 75 including an outer shroud block 80 or body for mounting a plurality of shrouds 85, such as stationary shrouds 85 disposed proximate a row of turbine buckets (not shown). FIG. 3 is a view in a circumferential direction, with a flow of the hot and energetic gas 30 that proceeds through the engine 20 directed from the left to the right, and a rotation of the buckets (not shown) about an axis 90 of the shaft 40 that defines an axial direction of the turbine 35 and outer shroud block 80. Accordingly, a pressure of the hot and energetic gas 30 is greater at a forward end 95 of the outer shroud block 80 (before imparting energy from the hot and energetic gas 30 to the assembly of buckets) as compared to an aft end 100 (following a transfer of some energy to the buckets).

FIG. 4 is a view in an axial forward direction opposite to the direction of flow of the hot and energetic gas 30 through the turbine 35. For example, flow of the hot and energetic gas 30 is directed out of the page of FIG. 4, which results in a counterclockwise rotation 103 of the turbine blades about the axis 90. Tips of the buckets (not shown) are disposed in close proximity to the shrouds 85. Any leakage of the hot and energetic gas 30 between the buckets and the shrouds 85 results in a loss of operation efficiency of the engine 20. For example, as a clearance between the tips of the buckets and shrouds 85 is increased, engine 20 efficiency decreases.

With reference to FIG. 4, the shroud block 80 carries preferably three individual shrouds 85. It will be appreciated that a plurality of shroud blocks 80 are disposed in a circumferential array about the axis 90 and mount a plurality of shrouds 85 surrounding and forming a part of the hot gas path flowing through the turbine 35. The shrouds 85 are formed of a ceramic composite, are secured by pins 105, 110 (best seen with reference to FIG. 3) to the shroud blocks 80, and have an inner surface 115 in contact with the hot and energetic gas 30 of the hot gas path.

Figure 5:
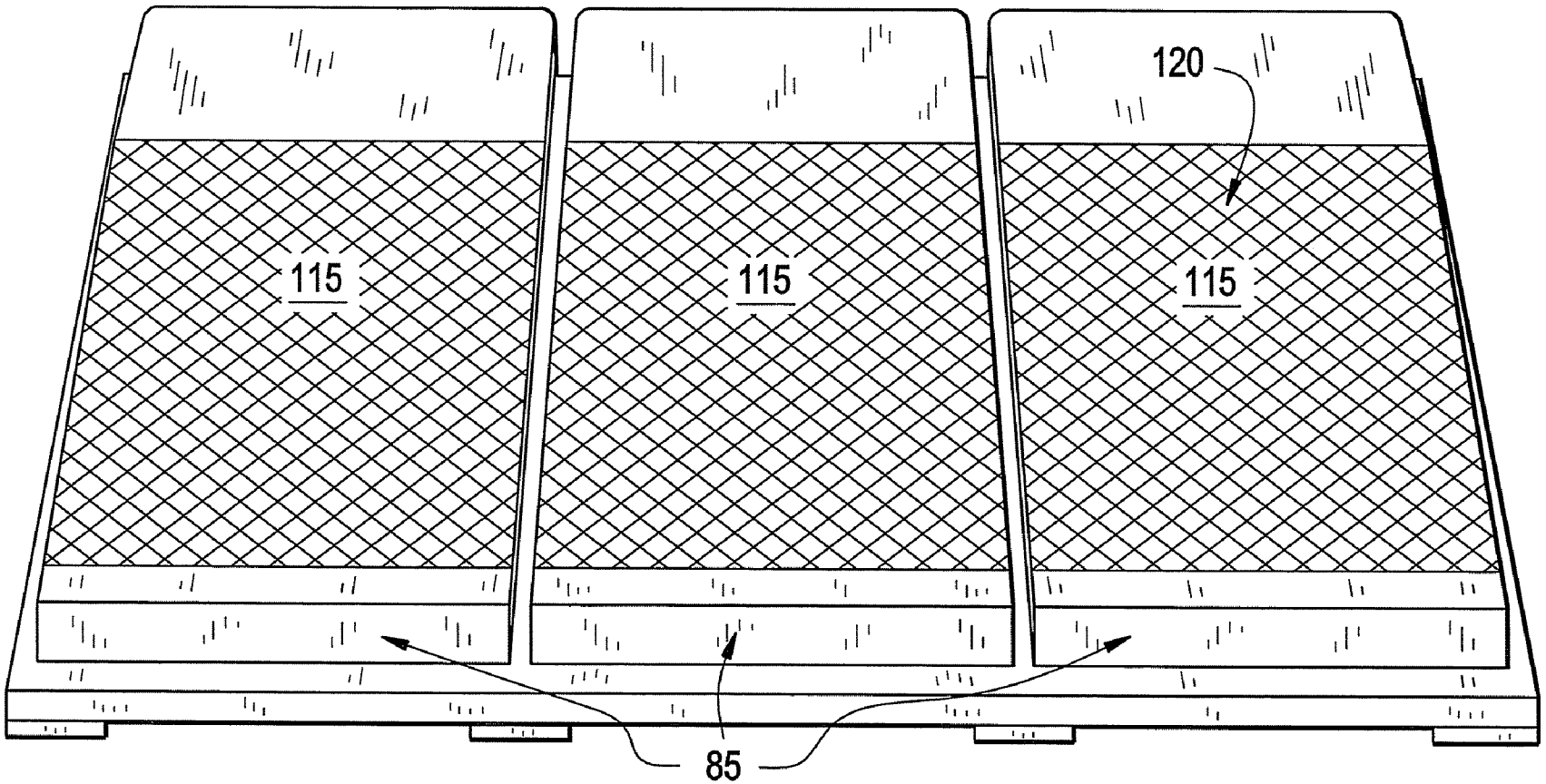
FIG. 5 depicts a top perspective view of shrouds surfaces in accordance with an embodiment of the invention.

FIG. 5 depicts an artistic rendition of a photograph of a bottom of the shroud assembly 75 of FIG. 4 having three shrouds 85. In an embodiment, the shrouds 85 include a ceramic matrix composite material (CMC) that provides enhanced high temperature performance. Embodiments of the CMC material are contemplated to include an environmental barrier coating (EBC) in conjunction with multi-directional ply architecture, such as melt-infiltrated silicon-carbide fiber-reinforced silicon carbide ceramic matrix composites (SiC/SiC CMCs). In an embodiment, the inner surface 115 of the shroud 85 including the CMC material further includes a raised pattern 120. It has been found that incorporating the raised pattern 120 within the inner surface 115 of the shroud 85 increases the surface area of the inner surface 115 and reduces airflow between rotating buckets and the shroud 85 to perform in a manner similar to a reduction in clearance between the rotating buckets and the shroud 85, thereby increasing operating efficiency. In a further embodiment, the raised pattern 120 includes CMC material that is abradable, such that tips of the buckets interfere with and abrade, or remove via wear a small amount of the abradable raised CMC material pattern 120 from the inner surface 115 of the shrouds 85, thereby providing a reduced clearance curvature within the inner surface 115 of the shrouds 85 that closely matches a curvature resulting from rotation of the tips of the buckets. Furthermore, use of the abradable material allows the reduced clearance to closely match the curvature resulting from rotation of the tips of the buckets without the complexity and cost associated with manufacturing such a curvature within the inner surface 115 of the shroud 85.

Referring back to FIGS. 3 and 4, the outer shroud block 80 fits into a case 125 (also herein referred to as a "casing") of the gas turbine 35. The shroud block 80 is mounted on, for example, a case 125 that extends further radially inward from an inner wall 130 of the case 125 toward the axis 90. A T-hook 135 may be arranged as an annular row of teeth that engage opposite sides of a groove 140 extending the length of the outer shroud block 80, such that the groove 140 provides a coupling to the T-hook 135 of the case 125. The outer shroud block 80 may be a unitary block that slides over the T-hook 135 or may be a pair of left and right block halves that are clamped over the T-hook 135. Each block 80 fits within a plenum cavity 145 within the case 125 and near the rotating portion of the turbine 35.

The outer shroud blocks 80 may be formed of a metal alloy that is sufficiently temperature tolerant to withstand temperatures of the burning exhaust gasses. A small portion of the metal outer shroud block 80 for example, near the shroud 85, may be exposed to hot and energetic gases 30 from the turbine 35 flow path.

Disposed within the outer shroud block 80 is a damper system 150. The damper system 150 includes a damper block/shroud interface 155, a damper load transfer mechanism 160 and a damping mechanism 165. The damper block/shroud interface 155 includes a damper block 170 in contact with the shroud 85. In an embodiment, the damper block 170 is formed of a metallic material, such as PM2000, a superalloy material having high temperature use limits of up to 2200 degrees F., for example. As depicted in FIGS. 3 and 4, a radially inwardly facing surface 175 of the damper block 170 and a radially outwardly facing surface 180 of the shroud 85 are parallel, adjacent, and in substantially surface to surface contact. In an embodiment, substantially all of an area of the radially inwardly facing surface 175, such as the surface area defined as within a perimeter 183 (best seen with reference to FIG. 6) of the damper block 170 for example, is in contact with the radially outwardly facing surface 180 of the shroud 85. Increasing an area of such surface to surface contact reduces an amount of stress developed within the shroud 85 responsive to loading between the shroud 85 and damper block 170, such as in response to pressure pulses generated by rotating buckets for example. The reduced contact stress on the damper block 170 results in reduced wear, and thereby provides an increased useful life of the damper block 170. Additionally, the surface to surface contact seals the surfaces 175, 180, thereby reducing flow of the hot and energetic gas 30 between the shroud 85 and damper block 170 from the forward end 95 toward the aft end 100 of the shroud assembly 75. For example, in an embodiment, each of the radially inwardly facing surface 175 and the radially outwardly facing surface 180 are flat surfaces 175, 180, and are in surface to surface contact.

Figure 6:
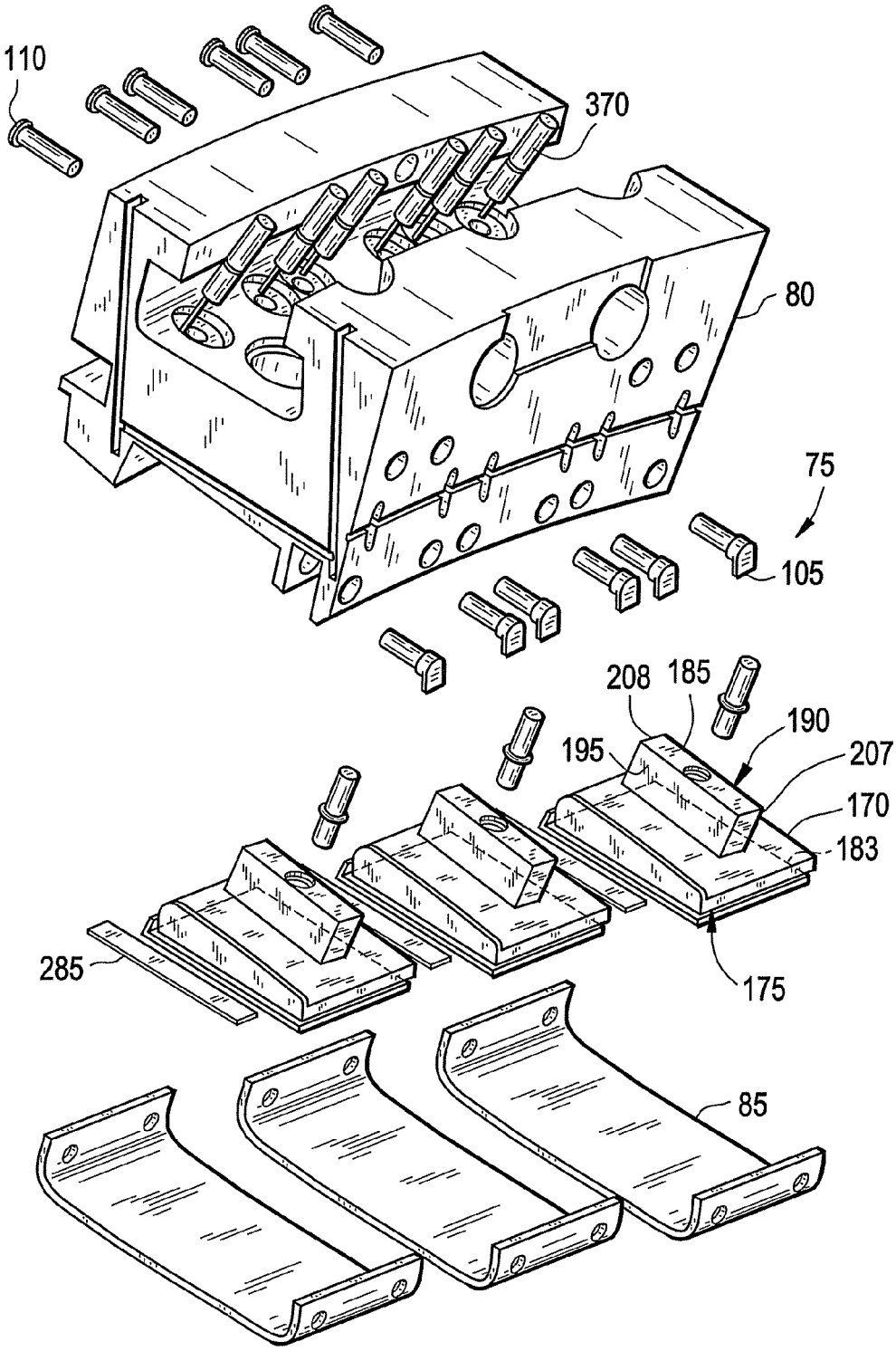
FIG. 6 depicts another isometric exploded assembly view of the shroud assembly in accordance with an embodiment of the invention.

FIG. 6 depicts an isometric exploded assembly view of the shroud assembly 75. With reference now to FIGS. 4 and 6, an upper guide 185 of the damper block 170 is depicted. The upper guide 185 includes prismatic geometry that interfaces with the outer shroud block 80 (best seen in FIG. 4). A close tolerance interface between the upper guide 185 and the outer shroud block 80 reduces leakage of cooling air between the upper guide 185 and outer shroud block 80. The upper guide 185 includes geometry having guide surfaces 190, 195 that mate, or interface with corresponding guiding surfaces 200, 205 of the outer shroud block 80. The guiding surfaces 200, 205, in conjunction with the guide surfaces 190, 195 define a translational degree of freedom of the damper block 170 relative to the outer shroud block 80, which defines a direction of motion 265 of the damper block 170. In an embodiment, the surfaces 190-205 are flat surfaces 190-205, such that the close tolerance interface between the flat surfaces 190-205 provide side to side location and prevent rotation of the damper block 170 within and relative to the outer shroud block 80. In one embodiment, the upper guide 185 includes four sides 190, 195, 207, 208 that define rectangular geometry.

With reference back to FIGS. 3 and 4, the damper load transfer mechanism 160 also includes a washer cup 210 and a thermally insulating washer 215. The washer 215 is disposed within the cup 210, which is in direct mechanical connection with the damper block 170. The cup 210 provides a support for the thermally insulating washer 215, which blocks the conductive heat path from the upper guide 185 of the damper block 170 to a biasing element 220, such as a spring, disposed proximate a first portion 222 of the outer shroud block 80. In an embodiment, the thermally insulating washer 215 includes materials such as monolithic ceramic silicone nitride and a machinable glass ceramic, such as MACOR (commercially available from Corning Inc., Corning N.Y.), for example.

The damping mechanism 165 includes the spring 220. The spring 220 is pre-conditioned at temperature and load prior to assembly in order to enhance consistency in structural compliance. The spring 220 is mounted within a cup-shaped block 225 that is mechanically retained within the shroud block 80, such as via threads, for example. The spring 220 is preloaded to engage at one end the insulative washer 215 to bias the damper block 170 radially inwardly via the washer cup 210. The opposite end of spring 220 is operatively connected to the outer shroud block 80 via the cup-shaped block 225.

FIG. 3 depicts a cooling passage 230 in fluid communication with the compressor 45 to provide a cooling flow of discharge air to the spring 220 via an internal cavity 235. The cup-shaped block 225 includes openings 240 that enable the cooling flow via the cooling passage 230 to maintain the temperature of the spring 220 below a predetermined temperature and therefore manage a stress-relaxation rate via forced convection. Thus, the spring can be made from low-temperature metal alloys and maintain a positive preload on the damper block 170 in the direction of motion 265, as will be described further below. Spent cooling medium is exhausted via a path 245. The washer cup 210 ensures retention and preload of the spring 220 in an event of a fracture of the insulative washer 215.

A bleed plug 250 is disposed in a counter bore 255 of the cooling passage 230. The bleed plug 250 includes a surface 260 that defines a bore to control an amount and rate of the cooling flow to the spring 220. For example, following simulated or instrumented tests, it may be determined that a particular rate of cooling flow maintains a desired maximum temperature of the spring 220. Cooling flow greater than the particular rate is undesired as it increases compressor 45 capacity requirements, and results in a loss of engine 20 efficiency. Furthermore, such coolant reductions improve transient (warm up) heat rate improvements. Accordingly, calculations may determine an appropriate geometry of the surface 260 to provide the desired flow rate and prevent unnecessary cooling flow greater than that determined to provide the desired temperature of the spring 220. In the event of a change in engine 20 operating parameters or desired cooling flow, a change of the bleed plug 250 having an appropriate surface 260 geometry may be performed.

A radial direction R of the turbine 35 is perpendicular to the axis 90. A bias force provided by the spring 220 between the block 180 and the damper block 170 is aligned with the direction of motion 265 of the damper block 170, which is offset relative to the radial direction R. For example, the direction of motion 265 and the radial direction R include an offset angle θ therebetween. Accordingly, the bias force of the spring 220, applied to the damper block 170, is directed along the direction of motion 265 and may be resolved into an axial component 270 aligned with the axis 90 and directed toward the aft end 100 of the outer shroud block 80 and a radial component 275 aligned with the radial direction R and directed radially inwardly.

In operation, the radial component 275 of the bias force of the spring 220 maintains a radial inwardly directed force on the damper block 170. The damper block 170, in turn, bears against the radially outwardly facing surface 180 of the shroud 85 to dampen vibration and particularly to avoid vibratory response of the shroud 85 at or near resonant frequencies. The axial component 270 of the bias force of the spring 220 provides an axial force to the damper block 170 directed toward the aft end 100 of a second portion 278 of the outer shroud block 80 disposed proximate the shroud 85. Therefore, a sealing surface 280 at an aft end 283 of the damper block 170 is disposed in contact with and biased toward the aft end 100 of the second portion 278 of the outer shroud block 80. The sealing surface 280 provides axial support to the damper block 170, reducing vibratory response of the damper block 170 and seals the damper block 170 with the outer shroud block 80. Sealing the damper block 170 to the outer shroud block 80 reduces bypass of hot and energetic gas 30 from the forward end 95 to the aft end 100 around the buckets, thereby enhancing efficiency of the engine 20.

FIG. 4 depicts seals 285 disposed within adjacent seal retention interfaces 290, such as seal retention slots for example, of adjacent damper blocks 170. The seals 285 and retention interfaces 290 are aligned with the axis 90. Accordingly, seals 285 are axial seals 285 and seal between the damper blocks 170, reducing bypass of the hot energetic gas 30 around the turbine blades. The axial seals 285 are made from an appropriate material to withstand the temperatures of the hot energetic gas 30, and may be known as "dog-bone seals". Bypass of the hot energetic gas 30 around the buckets is further reduced by disposing the shrouds 85 such that gaps 295 between adjacent shrouds 85 are circumferentially offset relative to gaps 300 between adjacent damper blocks 170. Disposal of the shrouds 85 such that the gaps 295 are circumferentially offset relative to gaps 300 results in a tortuous flow path 305 that provides a restriction to flow of the hot energetic gas 30 around the buckets.

Figure 7:
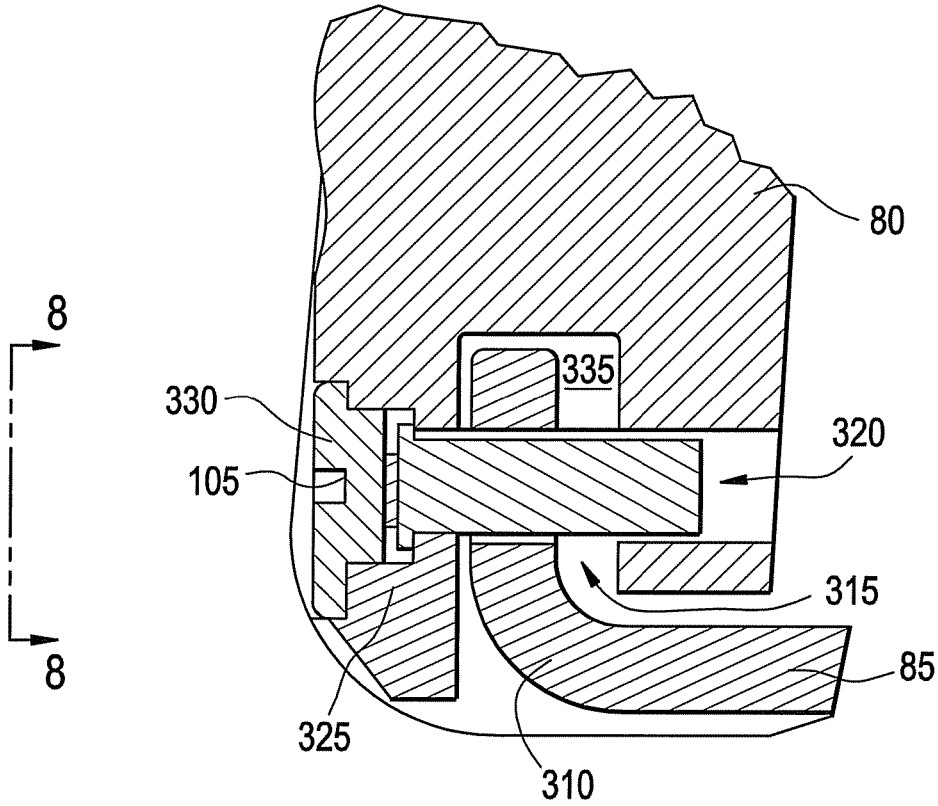
FIG. 7 depicts an enlarged cross section view of a forward flange section of a shroud and connector pin in accordance with an embodiment of the invention.

FIG. 7 is an enlarged view of a forward flange section 310 of the shroud 85 and the pin 105, such as a forward flange connector pin 105. The pin 105 is inserted through an aperture 315 of the forward flange 310 of the shroud 85. The pin 105 holds the shroud 85 in place in the support block 80 and opposes the radially inwardly directed force of the spring 220 applied via the damper block 170. The pin 105 fits into a pin aperture 320 in the block 80, which includes a recess 325 for a head 330 of the pin 105. The pin aperture 320 extends across a gap 335 in the outer shroud block 80 to receive the forward flange 310.

Figure 8:
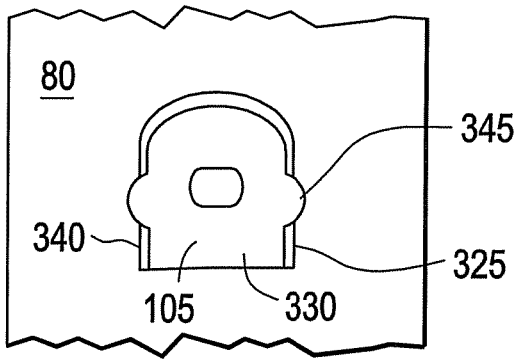
FIG. 8 depicts an enlarged end view of a forward flange section of the shroud and connector pin of FIG. 7 in accordance with an embodiment of the invention.

FIG. 8 depicts an end view of the pin 105 of FIG. 7 inserted within the block 80. The head 330 of the pin 105 and recess 325 of the block 80 include complementary geometry, such as elongated sides 340 engagable with the block 80 for example, to prevent rotation of the pin 105 subsequent to insertion within the block 80. An interface 345 between the head 330 of the pin 105 and the recess 325 of the block 80 retains the pin 105 within the block 80. Embodiments of the interface 345 are contemplated to include deformation interfaces 345 resulting via processes such as staking and orbital riveting for example. Further embodiments of the interface 345 are contemplated to include material transformation of the head 330, via processes such as welding, brazing, or soldering, for example. Use of the interface 345 eliminates incorporation of threads on the pin 105 or within the aperture 320 of the block 80, and thereby simplifies and reduces a cost of manufacturing the pin 105 and block 80, as well as reducing a likelihood of galling during removal of the pin 105 following operation of the engine 20.

Referring back now to FIG. 3, an aft flange 350 and pin 110, such as an aft flange connector pin 110, are depicted. Because the pin 110 is in direct contact with the shroud 85, use of an interface, such as the interface 345 to retain the forward flange connector pin 105 is not appropriate, as the ceramic material from which the shroud 85 is made is not capable of such interface retention methods.

The pin 110 is inserted through an aperture 355 of the aft flange 350 of the shroud 85. The pin 110 holds the shroud 85 in place in the support block 80 and opposes the radially inwardly directed force of the spring 220 applied via the damper block 170. The pin 110 fits into a pin aperture 360 in the block 80. The pin aperture 360 further includes a retention bore 365 into which a retention pin 370 is disposed. The pin 110 includes a retention aperture 375 through which an end 380 of the retention pin 370 is disposed, thereby retaining, and preventing both rotation and displacement of the pin 110. Subsequent to disposal of the retention pin 370 within the retention aperture 375, an interface 385 retains the retention pin 370 in place within the retention bore 365. Embodiments of the interface 385 are contemplated to include deformation of the retention pin 370, such as staking and orbital riveting for example, and material transformation of the retention pin 370, such as welding, brazing, or soldering, for example. Use of the retention pin 370 in conjunction with the interface 385 eliminates incorporation of threads on the pin 110 or within the pin aperture 360 of the block 80, and thereby simplifies and reduces a cost of manufacturing the pin 110 and block 80, as well as reducing a likelihood of galling during removal of the pin 110.

While an embodiment has been described having flat surfaces 175, 180 between the damper block 170 and the shroud 85, it will be appreciated that the scope of the invention is not so limited, and that the invention will also apply to embodiments of the shroud assembly 75 that utilize corresponding surfaces 175, 180 having alternate geometry to provide sealing, and transfer the radial component of spring 220 force, as curved, oval, intermeshing teeth, or other suitable geometry, for example.

While an embodiment has been described having flat surfaces to provide side to side location and prevent rotation of the damper block 170 within the outer shroud block 80, it will be appreciated that the scope of the invention is not so limited, and that the invention will also apply to embodiments of the shroud assembly 75 that utilize corresponding surfaces 190-205 having alternate geometry to provide sealing, side to side location, and prevent rotation, such as curved, oval, elliptical, triangular, or other suitable geometry for example. While an embodiment has been described having a spring 220 as biasing element 220, it will be appreciated that the scope of the invention is not so limited, and that the invention will also apply to embodiments of the shroud assembly that utilize alternate biasing elements 220 to bias the damper block 170 radially inwardly, such as a resilient feature integral with at least one of the damper block 170 and the outer shroud block 80, for example.

As disclosed, some embodiments of the invention may include some of the following advantages: increased engine efficiency via: enhanced sealing between the damper block and outer shroud block; enhanced sealing between adjacent damper blocks; to reduce; enhanced sealing by shroud gaps circumferentially offset from damper block gaps; enhanced sealing between close tolerance upper guide interface with the outer shroud block; increased area to area contact between the damper block and the shroud; reduced bucket to shroud clearance via abradable shroud materials; reduced manufacturing cost and increased ease of service via threadless shroud retention pins; and increased operational flexibility via interchangeable cooling passage bleed plugs.

While the invention has been described with reference to exemplary embodiments, it will be understood that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A support apparatus for a shroud of a gas turbine, the gas turbine comprising a rotating shaft defining a radial direction perpendicular thereto, the apparatus comprising:

an outer shroud block comprising a coupling connectable to a casing of the gas turbine;

a shroud component comprising a forward flange and an aft flange, the shroud component attached to the outer shroud block via the forward flange and the aft flange;

a damper disposed between the outer shroud block and the shroud component with a translational degree of freedom between the damper and the outer shroud block that defines a direction of motion of the damper, the direction of motion forming an angle greater than zero degrees relative to the radial direction of the gas turbine;

a biasing element disposed within the outer shroud block, the biasing element in operable connection between the outer shroud block and the shroud component via the damper, a bias force of the biasing element directed along the direction of motion of the damper;

a first pin extendible through an aperture in the forward flange or the aft flange, and a deformation interface between a head of the first pin and the outer shroud block.

2. The shroud support apparatus of claim 1, wherein:

the biasing element comprises a spring.

3. The shroud support apparatus of claim 1, wherein:

the outer shroud block comprises a first portion proximate the biasing element and a second portion proximate the shroud; and a component of the bias force of the biasing element biases an aft end of the damper toward the second portion of the outer shroud block.

4. The shroud support apparatus of claim 3, wherein:

the aft end of the damper comprises a sealing surface in contact with the outer shroud block.

5. The shroud support apparatus of claim 1, wherein:

the damper comprises a guide surface;

the outer shroud block comprises a guiding surface; and the guiding surface mates with the guide surface, thereby defining the translational degree of freedom of the damper relative to the outer shroud block.

6. The shroud support apparatus of claim 5, wherein:

the guide surface and the guiding surface each comprise complimentary geometry that prevents rotation of the damper relative to the outer shroud block.

7. The shroud support apparatus of claim 5, wherein:

the guide surface comprises four sides.

8. The shroud support apparatus of claim 1, wherein:

the outer shroud block comprises a cooling passage in fluid communication with the biasing element; and the apparatus further comprises a bleed plug disposed within the cooling passage, the bleed plug comprising a surface defining an opening passing through the bleed plug.

9. The shroud support apparatus of claim 1, wherein:

the shroud component is a stationary ceramic shroud component for a turbine bucket row of the gas turbine.

10. The shroud support apparatus of claim 9, wherein:

the stationary ceramic shroud component comprises a surface adjacent the turbine bucket row, the surface comprising a raised pattern.

11. The shroud support apparatus of claim 10, wherein:

the raised pattern comprises abradable ceramic matrix composite material.

12. The shroud support apparatus of claim 9, wherein:

the stationary ceramic shroud component comprises ceramic matrix composite material.

13. The shroud support apparatus of claim 9, wherein:

the stationary ceramic shroud component is one of a plurality of stationary ceramic shroud components; and the damper is one of a plurality of dampers, each damper of the plurality of dampers in contact with a respective one of the plurality of stationary ceramic shroud components.

14. The shroud support apparatus of claim 13, wherein:

each damper of the plurality of dampers comprises a seal retention interface; and the apparatus further comprises a seal disposed within each of two adjacent seal retention interfaces of two adjacent dampers of the plurality of dampers.

15. The shroud support of claim 13, wherein:

one of the plurality of stationary ceramic shroud components is disposed adjacent another of the plurality of stationary ceramic shroud components, thereby defining a first gap therebetween;

one of the plurality of dampers is disposed adjacent another of the plurality of dampers, thereby defining a second gap therebetween, the one and the another of the plurality of dampers are in contact with the respective one and the another stationary ceramic shrouds of the plurality of stationary ceramic shrouds; and the first gap is circumferentially offset relative to the second gap, thereby defining a tortuous flow path.

16. The shroud support of claim 1, wherein the head of the first pin and the outer shroud block each comprise complimentary geometry that prevents rotation of the first pin relative to the outer shroud block.

17. The shroud support of claim 1, wherein:

the damper comprises a first surface;

the shroud component comprises a second surface parallel and adjacent to the first surface; and the first surface contacts the second surface.

18. The shroud support of claim 17, wherein:

the first surface comprises a perimeter of the damper; and substantially all of an area of the first surface defined by the perimeter of the damper contacts the second surface.

19. A support apparatus for a shroud of a gas turbine, the gas turbine comprising a rotating shaft defining a radial direction perpendicular thereto, the apparatus comprising:

an outer shroud block comprising a coupling connectable to a casing of the gas turbine;

a melt-infiltrated ceramic matrix composite inner shroud component comprising a forward flange and an aft flange, the melt-infiltrated ceramic matrix composite inner shroud component shroud component attached to the outer shroud block via the forward flange and the aft flange;

a damper disposed between the outer shroud block and the melt-infiltrated ceramic matrix composite inner shroud component with a translational degree of freedom between the damper and the outer shroud block that defines a direction of motion of the damper, the direction of motion forming an angle greater than zero degrees relative to the radial direction of the gas turbine; and a biasing element disposed within the outer shroud block, the biasing element in operable connection between the outer shroud block and the melt-infiltrated ceramic matrix composite inner shroud component via the damper, a bias force of the biasing element directed along the direction of motion.

20. A support apparatus for a shroud of a gas turbine, the gas turbine comprising a rotating shaft defining a radial direction perpendicular thereto, the apparatus comprising:

an outer shroud block comprising a coupling connectable to a casing of the gas turbine;

a shroud component comprising a forward flange and an aft flange, the shroud component attached to the outer shroud block via the forward flange and the aft flange;

a damper disposed between the outer shroud block and the shroud component with a translational degree of freedom between the damper and the outer shroud block that defines a direction of motion of the damper, the direction of motion forming an angle greater than zero degrees relative to the radial direction of the gas turbine;

a biasing element disposed within the outer shroud block, the biasing element in operable connection between the outer shroud block and the shroud component via the damper, a bias force of the biasing element directed along the direction of motion of the damper;

a first pin extendible through an aperture in the aft flange or the forward flange, the first pin comprising a retention aperture; and a retention pin disposed within the retention aperture of the first pin.

21. A support apparatus for a shroud of a gas turbine, the gas turbine comprising a rotating shaft defining a radial direction perpendicular thereto, the apparatus comprising:

an outer shroud block comprising a coupling connectable to a casing of the gas turbine;

a shroud component comprising a forward flange and an aft flange, the shroud component attached to the outer shroud block via the forward flange and the aft flange;

a damper disposed between the outer shroud block and the shroud component with a translational degree of freedom between the damper and the outer shroud block that defines a direction of motion of the damper, the direction of motion forming an angle greater than zero degrees relative to the radial direction of the gas turbine;

a biasing element disposed within the outer shroud block, the biasing element in operable connection between the outer shroud block and the shroud component via the damper, a bias force of the biasing element directed along the direction of motion of the damper;

a first pin extendible through an aperture in the forward flange of the ceramic component, a deformation interface between a head of the first pin and the outer shroud block;

a second pin extendible through an aperture in the aft flange or the forward, the second pin comprising a retention aperture; and a retention pin disposed within the retention aperture of the second pin.

* * * * *